US005282368A

United States Patent [19]

Ordoukhanian

[11] Patent Number: 5,282,368

[45] Date of Patent: Feb. 1, 1994

[54] BEVERAGE COOLING DEVICE

[76] Inventor: Raymond D. Ordoukhanian, 4 Dorie, O'Fallon, Mo. 63366

[21] Appl. No.: 63,942

[22] Filed: May 17, 1993

[51] Int. Cl.[5] ..... F25D 3/08

[52] U.S. Cl. ..... 62/372; 62/381; 62/457.7; 248/214; 248/286; 366/232

[58] Field of Search ..... 62/457.7, 377, 381, 62/372, 293, 459; 366/144, 213, 220, 232; 248/214, 215, 286

[56] References Cited

U.S. PATENT DOCUMENTS

| | | | |
|---|---|---|---|
| 496,922 | 5/1893 | Wadhams . | |
| 507,996 | 11/1893 | Cobin et al. | 62/372 X |
| 2,216,762 | 10/1940 | Bolas | 62/34 |
| 2,655,007 | 10/1953 | Lazar | 62/381 X |
| 4,078,397 | 3/1978 | Brande | 62/372 |
| 4,139,992 | 2/1979 | Fraser | 62/381 X |
| 4,164,851 | 8/1979 | Bryant | 62/381 |
| 4,179,904 | 12/1979 | McClenny | 62/381 X |
| 4,549,409 | 10/1985 | Smith | 62/381 |
| 4,580,405 | 4/1986 | Cretzmeyer, III | 62/381 X |
| 4,813,243 | 3/1989 | Woods et al. | 62/381 |
| 4,825,665 | 5/1989 | Micallef | 62/372 |
| 5,005,378 | 4/1991 | Ottenheimer | 62/378 |

*Primary Examiner*—William E. Tapolcai
*Attorney, Agent, or Firm*—Grace J. Fishel

[57] ABSTRACT

A beverage cooling device for quick chilling beverages. The device rotates the beverage in a hollow receptacle such as an ordinary commercially available ice chest while positioning it vertically and at an angle such that it can be used with receptacles having a wide range of sizes.

10 Claims, 2 Drawing Sheets

BEVERAGE COOLING DEVICE

BACKGROUND OF THE INVENTION

1. Field of the Invention

The present invention relates to a beverage cooling device for quick chilling beverages such as beer or soda packaged in particular, although not exclusively, in metal cans. The invention may also be applied to beverages such as fruit juice packaged in glass or plastic bottles.

2. Brief Description of the Prior Art

On a hot summer day when a person is working or playing outside in the sun, a cold soda or beer is refreshing. But sometimes people forget to cool the soda or beer or sometimes there is not enough cold drinks to go around. Under these circumstances, there is a need for a device to quickly cool down a beverage container.

Sometimes a chilled beverage container warms up before it has been fully consumed causing the contents to become unpalatable. Unless the remainder can be quickly chilled, the alternatives are to waste it and open a new can or to drink the beverage warm. In view of this, there is also a need for a device for cooling an open container.

It is well known that a drink can be quickly chilled by shaking or rotating the container in ice by hand. The container is constantly turned or moved until the beverage is deemed ready to serve. The principal disadvantage of this method is that the person doing the work is detained from his leisure or his other duties while the beverage is being cooled.

A number of different devices have been proposed to mechanize turning or moving the container in a vessel of ice. The prior art devices, however, involve the use of specially constructed apparatus, including specially adapted buckets, ice chests and the like for containing the coolant or for mounting the device. None, insofar as known, can be used on commercially available insulated ice chests such as are in common use without some modification.

SUMMARY OF THE INVENTION

In view of the above, it is an object of the present invention to provide a device for chilling a beverage container which can be used with an ordinary ice chest and which eliminates the need for attention during the chilling operation. It is another object to provide a device which can be used to rechill an open container held at an angle below the ullage level. Other objects and features of the invention will be in part apparent and in part pointed out hereinafter.

In accordance with the invention, a beverage cooling device is provided for supporting and rotating a beverage container in a hollow receptacle adapted to hold ice and the beverage container. The receptacle has a base surrounded with side walls and an upwardly facing open top.

The cooling device has a vertical support for attachment to the top of the side walls. There is a vertically adjustable slide mounted on the vertical support with means for locking the slide in a selected position. A clutch coupling is mounted on the slide with a fixed member and a movable member in such manner that the movable member is rotatable about a horizontal axis. A drive mechanism is attached to the movable member of the clutch coupling and a sleeve is coupled to the drive mechanism. The sleeve is adapted to frictionally grip a beverage container.

The container rotates with the sleeve and is quickly chilled by the ice in the receptacle. The device holds the container at a level and at an angle determined by the position of the adjustable slide on the vertical support and the position of the movable member of the clutch coupling. This permits the device to be used with receptacles having a wide range of sizes.

The invention summarized above comprises the constructions hereinafter described, the scope of the invention being indicated by the subjoined claims.

BRIEF DESCRIPTION OF THE DRAWINGS

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
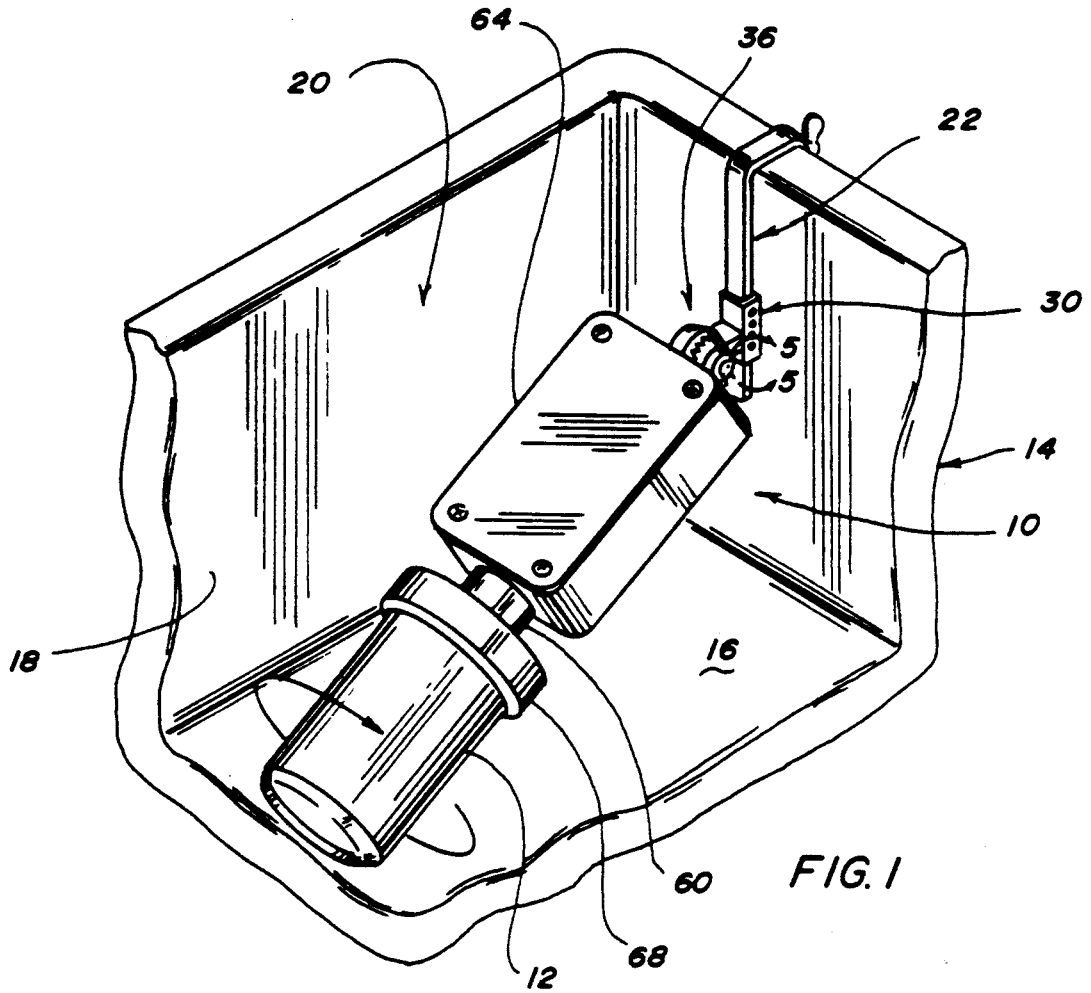
FIG. 1 is a perspective view of a beverage cooling device in accordance with the present invention in use on an ordinary ice chest.

Referring to the drawings more particularly by reference character, reference numeral 10 refers to a beverage cooling device in accordance with the present invention. Device 10 is designed to support and rotate a container 12 of canned or bottled beverages along its longitudinal axis in proximity to a cold substance. Device 10 is adapted for use in a hollow receptacle 14 having a base 16 surrounded with side walls 18 and an upwardly facing open top 20. Open top 20 is usually provisioned with a lid (not shown) which may be a separate element or which may be hinged to receptacle 14 along one of side walls 18. Suitable receptacles 14 include foamed insulated ice chests such as are in common use and are available from a number of manufacturers in a range of sizes.

Figure 2:
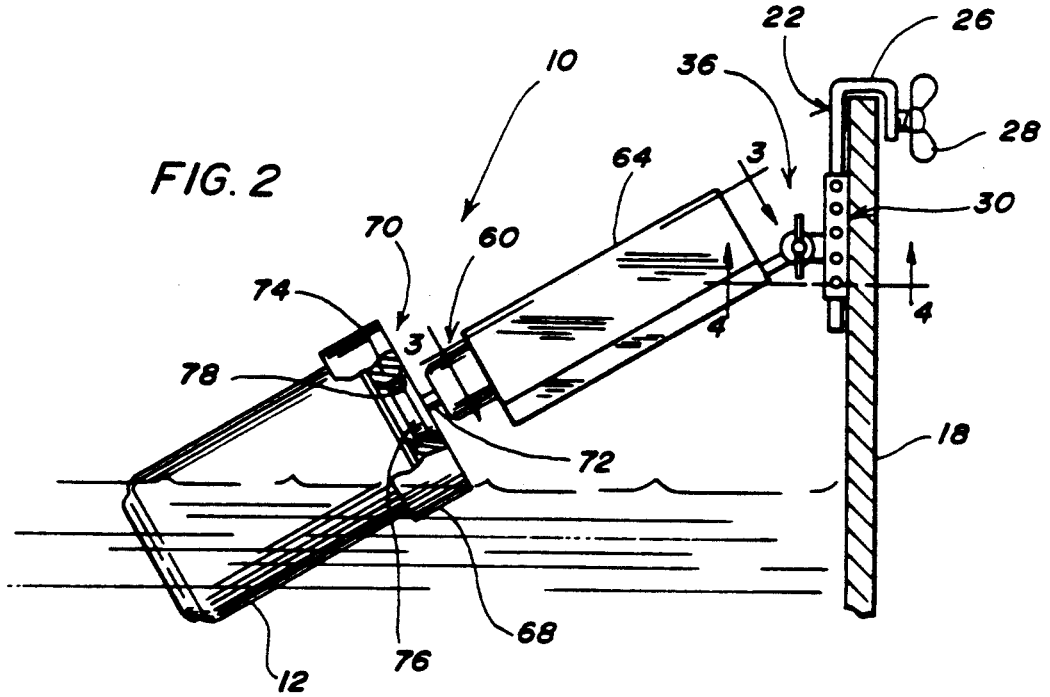
FIG. 2 is a side elevational view of the beverage cooling device with portions partially broken away to show details.
Figure 5:
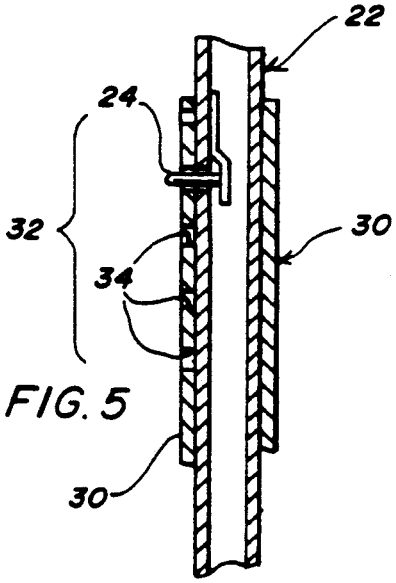
FIG. 5 is a view taken along line 5—5 in FIG. 1.

Device 10 has a vertical support 22 for attachment along the top edge of one of side walls 18. As shown in FIGS. 2 and 5, support 22 is a hollow rod which is rectangular in cross-section with a spring loaded pin 24 at one end and a hook 26 at the other. The width of hook 26 is such that it fits over the top edge of most commercially available ice chests. The tip of hook 26 may be provisioned with a thumb screw 28 by means of which support 22 can be clamped to side wall 18.

A vertically adjustable slide 30 is mounted on support 22 opposite hook 26. Referring again to FIG. 5, slide 30 is illustrated as a hollow rod which is rectangular in section and sized such that it slips over the hollow rod serving as support 22. It will be understood that slide 30 and support 22 can take other forms. For example, slide 30 and support 22 may be C-shaped in cross-section and telescope like the sections of a curtain rod. Other possibilities will occur to those skilled in the art and are part of the present disclosure. With continuing reference to FIG. 5, it is seen that slide 30 has a means for locking 32 the slide in a selected position. In the form illustrated, locking means 32 comprises a row of holes 34 into which spring loaded pin 24 latches.

Figure 4:
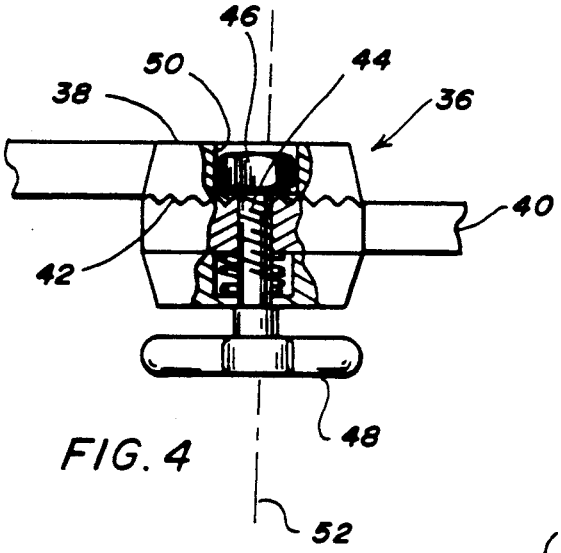
FIG. 4 is a view taken in the direction of line 4—4 in FIG. 2 with portions partially broken away to show details.

A clutch coupling 36 having a fixed member 38 and a movable member 40 is mounted on slide 30. As shown in FIG. 4, fixed and movable members 38, 40 have interlocking teeth 42 or projecting lugs which are kept from disengaging by axial pressure applied by tightening a bolt 44 into a nut 46 with a knob 48. Nut 46 is collared by a recess 50 provided in clutch coupling 36 so that it does not rotate with knob 48. When fixed and movable members 38, 40 are disengaged, the movable member is rotatable about a horizontal axis 52.

Figure 6:
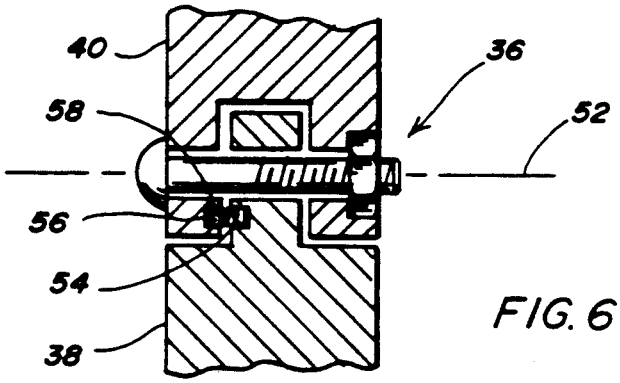
FIG. 6 is a sectional view of a second clutch coupling.

Other suitable clutch couplings 36 may be used, one of which is shown in FIG. 6. As shown in FIG. 6, fixed and movable members 38, 40 are held in a selected position by means of a spring 54 loaded roller ball 56. Ball 56 is seated in one of a number of recesses 58 provided in movable member 40 and changes seats when a user applies a vertical force on the movable member sufficient to depress the spring. When spring 54 is depressed, ball 56 slides or rolls across the adjacent surface of movable member 40 until it is received in the next recess 58 and so forth until movable member 40 is placed at a desired angle with respect to side walls 18 and base 16. Once the user has positioned movable member 40, spring 54 applies sufficient pressure on ball 56 as to hold fixed and movable members 38, 40 in their selected relative position.

Figure 3:
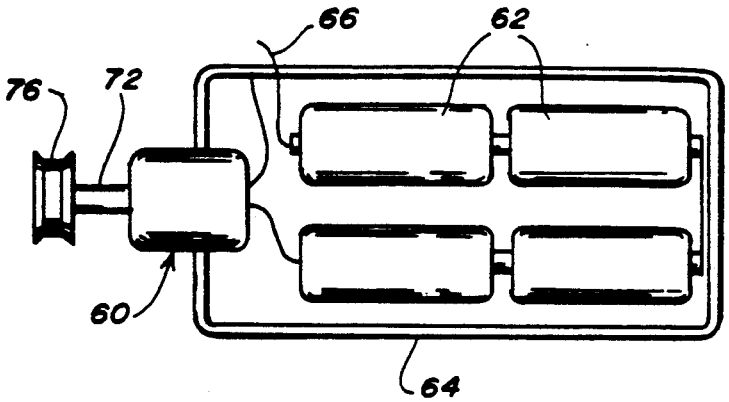
FIG. 3 is a view taken along line 3—3 in FIG. 2.

A drive mechanism 60 is attached to movable member 40. Drive mechanism 60 is preferably a battery operated electric motor as shown in FIG. 3. In the form illustrated, batteries 62 are housed in a battery case 64 which is attached to movable member 40. Motor 60 is then mounted on battery case 64 opposite movable member 40. It will be understood, however, that the invention is not limited to the use of DC power. While battery power is preferred for outside use, motor 60 can be operated on AC power if portability is not necessary. An on/off switch 66 is provided on motor 60 and is operable to make or break the connection between the electric source (e.g., batteries 62) and motor 60 for controlling the power supply to the electric motor. There may be timing means (not shown) associated with motor 60 so as to switch off the motor after predetermined period has elapsed. The speed at which motor 60 is operated, as well as the duration of predetermined time for which the electric motor operates before it is switched off, may be adjustable.

A sleeve 68 is coupled to drive mechanism 60 by a rotary transmission arrangement 70. As seen in FIG. 2, rotary transmission arrangement 70 takes the form of a shaft 72 driven by motor 60 and a closed end 74 of sleeve 68. Shaft 72 terminates in a pulley 76 that is keyed to and rotates with the shaft and which is received in an aperture 78 provided in closed end 74 of sleeve 68. The fit between pulley 76 and aperture 78 is tight such that sleeve 68 rotates with shaft 72. Other rotary transmission arrangements may be used between sleeve 68 and motor 60 such as direct gearing and so forth.

Sleeve 68 is lined or made completely of foamed or otherwise resilient plastic material for gripping a metal beverage can. Sleeve 68 is preferably stretchy to accommodate any variance in the outside diameter of metal beverage cans. While sleeve 68 is usually adapted for gripping metal beverage cans, it can be adapted (or used) for gripping glass or plastic bottles that can be fitted into the sleeve. As shown in the drawings, sleeve 68 preferably extends a short distance over the length of the beverage container so that it can be easily slipped in and out of the sleeve. Good results have been obtained, for example, when sleeve 68 is about 1-½ to 3 inches in length.

In use, receptacle 14 is filled with ice to a selected level and salt added if desired to speed up the action of the ice and provide a colder ice bath. Support 22 is hooked over one of side walls 18 and clamped in place by tightening thumb screw 28. One end of beverage container 12 is then slipped into sleeve 68 and clutch coupling 36 (and/or slide 30) adjusted until container 12 is received in receptacle 14 and makes contact with the ice. Switch 66 is actuated and container 12 rotated in the ice until switch 66 is manually turned off or until it automatically times out.

As the container is rotated in the ice, the beverage moves around in the container and heat passes from the beverage, through the wall of the container and into the ice. Once rotation of the container stops, the container can be removed from the sleeve and the contents served.

It will be apparent that device 10 can be used with an open beverage can so long as clutch coupling 36 holds container 12 at an angle above the ullage level. Hence device 10 can be used to quickly cool a partially consumed can of soda or beer thus avoiding waste or, in the alternative, drinking the beverage warm. Device 10 can also be used with plastic or glass bottles when the base of the bottle can be inserted into sleeve 68. Plastic or glass bottles can also be rechilled in device 10 if they can be recapped.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A beverage cooling device for supporting and rotating a beverage container in a hollow receptacle adapted to hold ice and having a base surrounded with side walls and an upwardly facing open top, said cooling device comprising:

a vertical support for attachment to a top edge of the side walls;

a vertically adjustable slide mounted on the vertical support with means for locking the slide in a selected position;

a clutch coupling mounted on the slide with a fixed member and a movable member, said movable member rotatable about a horizontal axis;

a drive mechanism attached to the movable member of the clutch coupling;

a sleeve coupled to the drive mechanism, said sleeve adapted to frictionally grip a beverage container;

whereby the container is rotated by the sleeve at a level in the receptacle determined by the position of the adjustable slide on the vertical support and at an angle determined by the position of the movable member of the clutch coupling so that the device can be used with receptacles having a wide range of sizes.

2. The device of claim 1 wherein the drive mechanism is a battery powered motor.

3. The device of claim 2 wherein the sleeve is formed of resilient plastic material and is adapted to grip a metal beverage can.

4. The device of claim 3 wherein the sleeve partially extends over the metal beverage can.

5. A beverage cooling device for supporting and rotating a beverage container in an ice chest having a base surrounded with side walls and an upwardly facing open top, said cooling device comprising:

a vertical support with a hook at one end for attachment to a top edge of the side walls;

a vertically adjustable slide mounted on the vertical support with means for locking the slide in a selected position;

a clutch coupling mounted on the slide with a fixed member and a movable member, said movable member rotatable about a horizontal axis;

a drive mechanism attached to the movable member of the clutch coupling, said drive mechanism having a drive shaft;

a sleeve coupled to the drive shaft, said sleeve adapted to frictionally grip a beverage container;

whereby the container is rotated by the sleeve at a level in the ice chest determined by the position of the adjustable slide on the vertical support and at an angle determined by the position of the movable member of the clutch coupling so that the device can be used with ice chests having a wide range of sizes.

6. The device of claim 5 wherein the drive mechanism is a battery powered electric motor and a pulley is fixed to and rotates with the drive shaft and wherein the sleeve has a closed end with an aperture having side walls adapted to grip the pulley, said sleeve coupled to the drive shaft when the pulley is gripped by the side walls of the aperture and the sleeve rotates with the pulley.

7. The device of claim 6 wherein the sleeve is formed of resilient plastic material and is adapted to grip a metal beverage can.

8. The device of claim 7 wherein the sleeve partially extends over the metal beverage can.

9. The device of claim 8 wherein the fixed and movable members of the clutch coupling have interlocking teeth which are kept from disengaging by axial pressure applied with a bolt.

10. The device of claim 8 wherein the fixed and movable members of the clutch coupling are held in a selected position by means of a spring loaded roller ball.

* * * * *